US008695505B2

(12) United States Patent
Koekemoer et al.

(10) Patent No.: US 8,695,505 B2
(45) Date of Patent: Apr. 15, 2014

(54) DETONATOR

(75) Inventors: Andre Louis Koekemoer, Boksburg (ZA); Johannes Petrus Kruger, Kempton Park (ZA); Christopher Malcolm Birkin, Centurion (ZA)

(73) Assignee: Detnet South Africa (Pty) Ltd. (ZA)

( * ) Notice: Subject to any disclaimer, the term of this patent is extended or adjusted under 35 U.S.C. 154(b) by 0 days.

(21) Appl. No.: 13/145,592

(22) PCT Filed: Jan. 10, 2010

(86) PCT No.: PCT/ZA2010/000059

§ 371 (c)(1),
(2), (4) Date: Sep. 19, 2011

(87) PCT Pub. No.: WO2011/044593

PCT Pub. Date: Apr. 14, 2011

(65) Prior Publication Data

US 2012/0111216 A1 May 10, 2012

(30) Foreign Application Priority Data

Oct. 5, 2009 (ZA) ..... 2009/06891

(51) Int. Cl.
*F42D 1/045* (2006.01)
*F42D 1/05* (2006.01)

(52) U.S. Cl.
USPC ..... 102/206; 102/201; 102/202.5; 102/262; 102/322

(58) Field of Classification Search
USPC ..... 102/201, 202, 202.5, 202.7, 206, 275.5, 102/275.6, 275.8, 202.1, 202.2, 202.3, 262, 102/322
See application file for complete search history.

(56) References Cited

U.S. PATENT DOCUMENTS

| | | | | |
|---|---|---|---|---|
| 3,977,329 | A | 8/1976 | Wilde | |
| 5,133,257 | A | 7/1992 | Jonsson | |
| 5,252,796 | A | 10/1993 | Hedger | |
| 6,272,965 | B1 | 8/2001 | Baginski et al. | |
| 6,814,005 | B1 * | 11/2004 | Vestre | 102/202.5 |
| 7,624,681 | B2 | 12/2009 | Goodman et al. | |
| 8,327,764 | B2 * | 12/2012 | Trousselle et al. | 102/202.3 |
| 2006/0249045 | A1 | 11/2006 | Goodman et al. | |

FOREIGN PATENT DOCUMENTS

| | | | |
|---|---|---|---|
| DE | 4427296 | A1 | 2/1996 |
| WO | 01/18484 | A1 | 3/2001 |

OTHER PUBLICATIONS

English Abstract of German Patent Publication No. 44 27 296 A1, published Feb. 8, 1996.
English specification of South African Patent Application No. 95/6449, filed Aug. 2, 1995, published May 29, 1996, corresponding to German Patent Publication No. 44 27 296 A1.
International Search Report for PCT/ZA2010/000059, international fileing date of Jan. 10, 2010, 5 pages.
International Preliminary Report on Patentability for international application No. PCT/ZA2010/000059, international filing date of Oct. 1, 2010, mailed Apr. 11, 2012, 5 pages.

* cited by examiner

*Primary Examiner* — James Bergin
(74) *Attorney, Agent, or Firm* — Cantor Colburn LLP

(57) ABSTRACT

A detonator (120) which has a battery (136) which is movable by a pressure wave from a shock tube (158) to a position at which the battery is placed in electrical contact with a circuit (130) which controls firing of an ignition element (128).

8 Claims, 5 Drawing Sheets

DETONATOR

CROSS-REFERENCE TO RELATED APPLICATIONS

This application is a U.S. national stage application of International Application No. PCT/ZA2010/000059, which has an international filing date of Jan. 10, 2010, and which claims priority to South African Patent Application No. 2009/06891, filed Oct. 5, 2009.

BACKGROUND OF THE INVENTION

1. Field of the Invention

This invention relates to an electronic detonator.

2. Related Art

Electronic detonators can be interconnected, in a detonator system, by using electrical conductors. These conductors are used to establish the detonator system, to enable data and timing information to be loaded into the individual detonators and, ultimately, to transmit signals for firing the detonators. When the detonators are fired the electrical conductors are, for practical purposes, destroyed. The cost of the conductors, typically of copper, can be high and constitutes a significant part of the overall cost of a detonator system.

Alternative approaches have been used to establish detonator systems. For example, detonators can be interconnected using fibre optic cables. It is also possible to fire detonators using radio frequency signals. These techniques have, however, not been adopted on a large scale.

An electronic detonator has a significant favourable factor in that it can be programmed with a time delay which is executed in a highly reliable manner with a small error. It is desirable therefore to make use of electronic detonators but, as far as is practically possible, the use of electrical conductors between detonators should be reduced to a minimum.

SUMMARY OF THE INVENTION

The invention provides a detonator which includes a housing and, within the housing, a circuit and an electrical energy source, and at least one switch which is operable in response to energy emitted by a shock tube to connect the electrical energy source to the circuit.

At least two switches may be used with each switch being responsive to energy in a different form. In this case, the switches are preferably connected in series and optionally are connected via an AND gate or a similar device to ensure that a connection is established between the electrical energy source and the circuit only if the switches are responsive, substantially simultaneously, to energy from a shock tube.

The detonator may include an ignition element, e.g., a fuse head, and a shunt may be established across the ignition element but positioned so that the shunt is open-circuited, and preferably is destroyed, by energy from the shock tube.

In order to enhance the safety of the detonator, a minimum amount of energy may be required from the shock tube to cause operation of the switch. The minimum energy requirement can be met in different ways and, by way of example only, an appropriate switch is operable only when a retentive force is exceeded by force exerted on the switch by a pressure wave which is produced by energy released from the shock tube. The retentive force, in turn, may be determined by means of a mechanical component constituted, for example, by one or more formations in the housing, e.g., crimps or other constricted formations.

In one form of the invention the housing includes a first compartment which receives an end of shock tube and a second compartment which contains the energy source and the circuit.

In one embodiment the switch is constituted by the electrical energy source which is physically movable, by a pressure wave produced by the shock tube, from an inoperative position to an operative position at which the electrical energy source is connected to the circuit.

The electrical energy source may be mounted to a cartridge which is movable, by the pressure wave, within the housing or an extension thereof, to bring the electrical energy source to the operative position.

The housing may be electrically conductive, for example, made from a suitable metal, or include or contain a conductive strip or element so that an electrical connection is effected between one terminal of the electrical energy source and the circuit. Movement of the electrical energy source to the operative position is then required to connect a second terminal of the electrical energy source to the circuit.

Movement of the electrical energy source to the operative position may be against a retentive force which must be overcome by the pressure wave. The electrical energy source may be locked against further movement at the operative position, for example, by means of inter-engaging retention formations.

In a preferred embodiment, the detonator includes an elongate tubular housing, a circuit in the housing, an electrical energy source which is displaced from the circuit, and a connector for connecting an end of the shock tube to the housing and wherein, when a pressure wave at a suitable level is produced by the shock tube, relative movement between the circuit and the electrical energy source takes place so that the electrical energy source is thereby electrically connected to the circuit.

In one form of the invention the circuit is at a fixed location within the tubular housing and the electrical energy source is mounted to a cartridge which is slidably movable within the housing by means of a pressure wave produced by the shock tube, against a retentive force, to an operative position at which the electrical energy source is connected to the circuit and at which the cartridge is restrained against further movement relative to the housing.

Preferably, a terminal of the electrical energy source is directly connected to the circuit and a second terminal of the electrical energy source is brought into electrical engagement with a chosen contact point of the circuit, as the electrical energy source moves to the operative position, thereby to effect a complete electrical connection between the electrical energy source and the circuit.

The pressure wave may be directed through one or more shaped apertures to obtain the aforementioned relative movement.

Preferably at least one aperture is in the form of a passage which has a larger area at its outlet than at its inlet.

The passage may, over at least part of its length, be flared outwardly, e.g., in the form of a cone.

BRIEF DESCRIPTION OF THE DRAWINGS

The invention is further described by way of examples with reference to the accompanying drawings in which.

DESCRIPTION OF PREFERRED EMBODIMENTS

Figure 1:
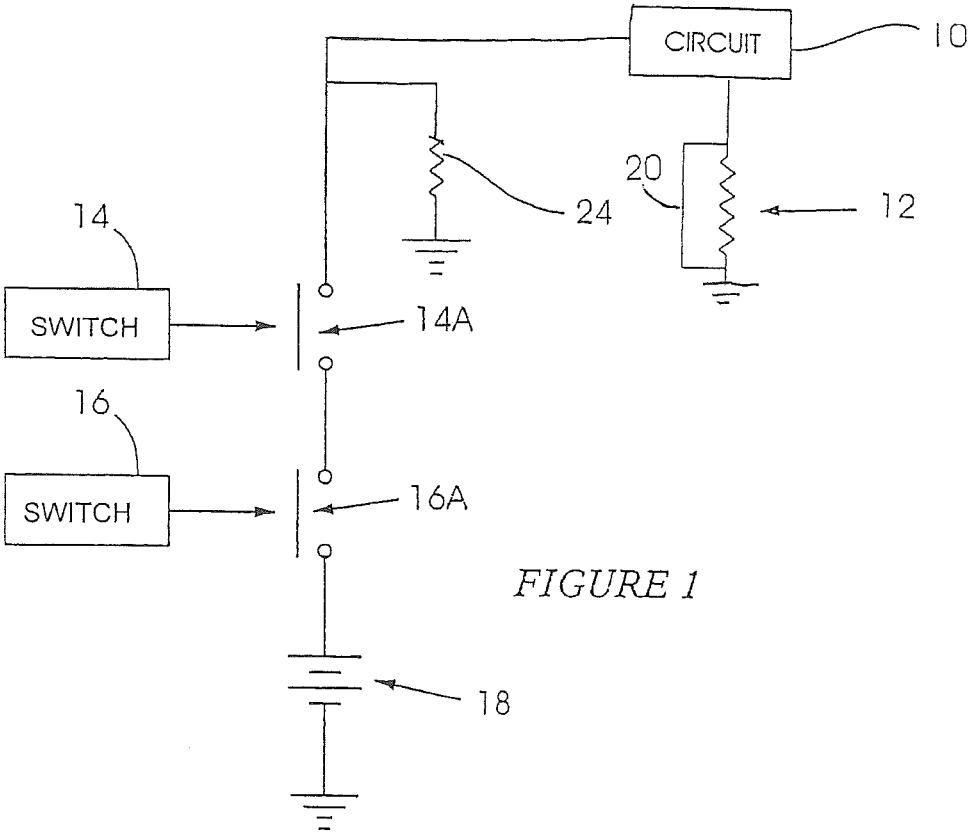
FIG. 1 is a block diagram of a detonator according to one form of the invention.

A conceptual basis of the invention is readily apparent from FIG. 1 of the accompanying drawings which illustrates a detonator circuit 10 which is positioned in series with a fuse head or ignition element 12, a first switch 14, a second switch 16 and an energy source in the form of a battery 18.

The circuit 10 may be of any kind known in the art. Usually the circuit 10 has a memory in which is stored a delay time. When the circuit is connected to the battery 18 and is correctly powered it is capable of generating a firing signal which causes ignition of the fuse head 12 and, in this way, a primary explosive, not shown, carried in a housing of the detonator is ignited.

The fuse head is bridged by means of a shunt conductor 20.

The switches 14 and 16 are actuable to close respective contacts 14A and 16A. If the switches are simultaneously closed, the battery 18 is directly connected to the circuit 10. The circuit 10 includes at least a further switching mechanism and, upon operation thereof, current can flow from the battery through the fuse head and cause its ignition. However, if the shunt 20 is in position, and if the integrity of the shunt is not compromised, the electrical current will flow primarily through the shunt and not through the fuse head. In other words, it is necessary for the shunt to be open circuited, or removed, in order for the fuse head to be ignited.

As is explained hereinafter the switches 14 and 16, which are in series, may be sensors which are responsive to the effects of energy emitted by a shock tube. When a signal is propagated by the shock tube to the detonator the switches 14 and 16 respond to energy emitted by the shock tube and close the contacts 14A and 16A and thus connect the battery to the circuit 10. The switches must be operated in unison for a closed path to exist between the battery and the circuit. Also, it is necessary for the shunt 20 to be open circuited before the ignition element can be fired. Thus there are three levels of safety adopted in the approach shown in FIG. 1 and all three safety factors must be complied with in order to fire the ignition element.

The arrangement shown in FIG. 1 includes a drain resistor 24. If the switches 14 and 16 are operated and the shunt 20 is open circuited then, if a firing signal is not forthcoming from the circuit 10 within a predetermined time period, the battery 18 is gradually discharged through the resistor 24 and ultimately a stage is reached at which the battery is incapable of operating the circuit 10. This is a safety feature which allows the detonator to be rendered safe within a reasonable time period if a malfunction of a particular kind occurs.

Figure 2:
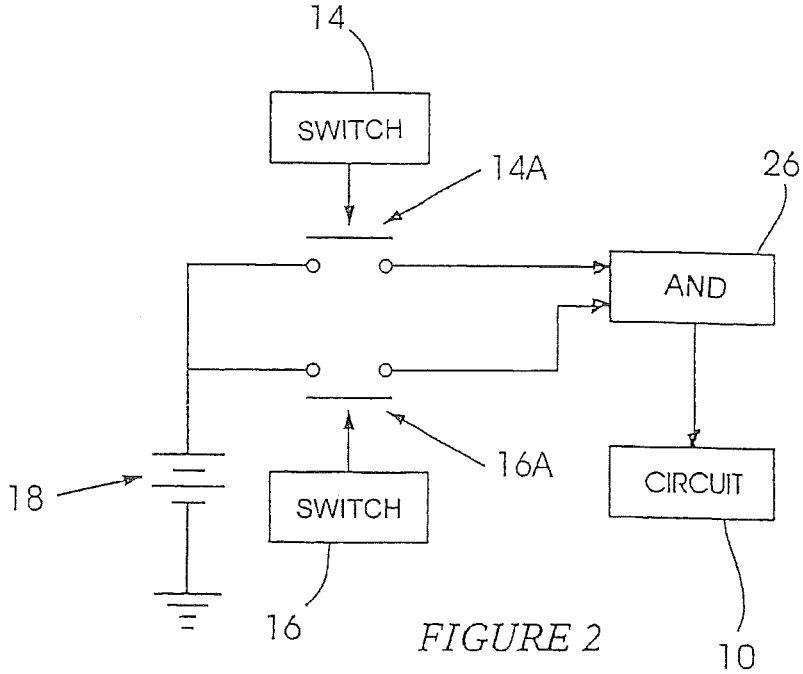
FIG. 2 shows a modification to the arrangement in FIG. 1.

FIG. 2 illustrates a variation to the series connection of the switches 14 and 16. The respective switches are connected as inputs to an AND gate 26 and must be operated at the same time for the AND gate 26 to have a positive output which can be used to enable the circuit 10.

Figure 3:
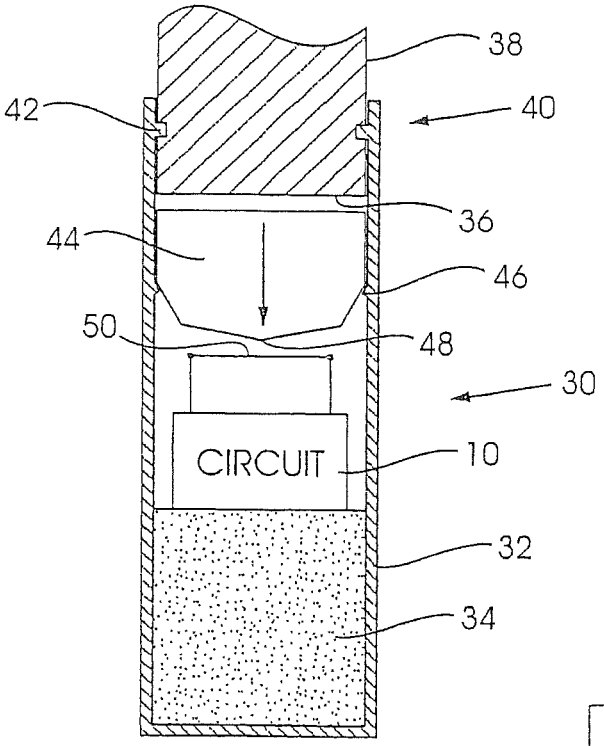
FIGS. 3 and 4 show different techniques which can be adopted in a detonator according to the invention.

FIG. 3 illustrates a detonator 30 which includes a housing 32 in the form of an elongate tube in which is located the circuit 10 and a primary explosive 34. An end 36 of an elongate shock tube 38 is positioned in a mouth 40 of the housing 32 and is fixed in place by an inward deformation of the housing at a location 42 which is close to the mouth. A plunger 44 is frictionally locked to the housing by a constriction 46. The plunger has a slightly pointed leading end 48 which faces a shunt wire 50 which corresponds to the shunt 20 shown in FIG. 1 and which is connected to the circuit 10.

If the shock tube 38 is ignited then a shock wave ultimately reaches the end 36. A pressure wave which is produced at the end impacts on the plunger 44. The pressure wave must have sufficient impact force in order to move the plunger against the constriction 46 and, when this occurs, the plunger is urged towards the shunt wire and breaks it. This is equivalent to an open circuit of the shunt 20 shown in FIG. 1 and it is then possible for a fuse head, not shown in FIG. 3, to be activated by the circuit 10. The plunger thus acts as a switch which, when operated, open circuits the shunt.

The constriction 46 is used to ensure that at least a minimum amount of energy is needed in order for the plunger 44 to exhibit its switching action. This is a safeguard to prevent inadvertent actuation of the plunger, for example, if the detonator is dropped.

Figure 4:
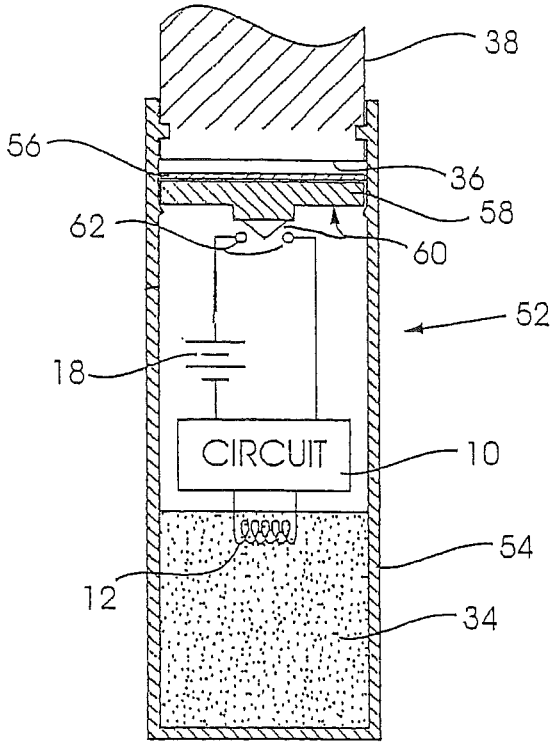

FIG. 4 shows a detonator 52 which has a detonator tube 54, a primary explosive 34 and a shock tube 38. An end 36 of the shock tube is crimped in position at a mouth of the detonator tube. The end 36 opposes a membrane 56 which is broken when a pressure wave is produced by energy which is emitted by the shock tube.

A plunger 58 has a conductive undersurface 60 which opposes a spaced pair of contacts 62 which are connected to the circuit 10 and to a battery 18. With this arrangement a pressure wave produced at the end of the shock tube is used to break the membrane and then urge the plunger 58 into electrical engagement with the contacts 62. The resulting switching action connects the circuit 10 electrically to the battery 18 and a fuse head 12, exposed to the explosive 34, can then be fired in a controlled way.

Figure 5:
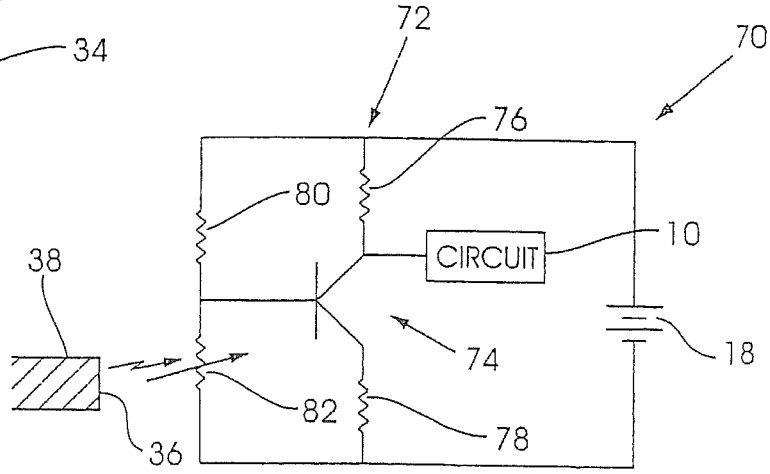
FIGS. 5 and 6 show sensing circuits which can be used as switches.

FIG. 5 shows a circuit 70 in which the battery 18 is coupled to a switching circuit 72 which includes a transistor 74 in series with resistors 76 and 78. A base of the transistor is connected to a junction of a resistor 80 and a light-dependent resistor 82 which is positioned so that light which is emitted by an end 36 of a shock tube 38, upon propagation of a shock wave to the end 36, is incident on the light-dependent resistor 82. When this occurs the transistor 74 is switched and a voltage at the collector of the transistor is then connected to the circuit 10 to enable the circuit.

Figure 6:
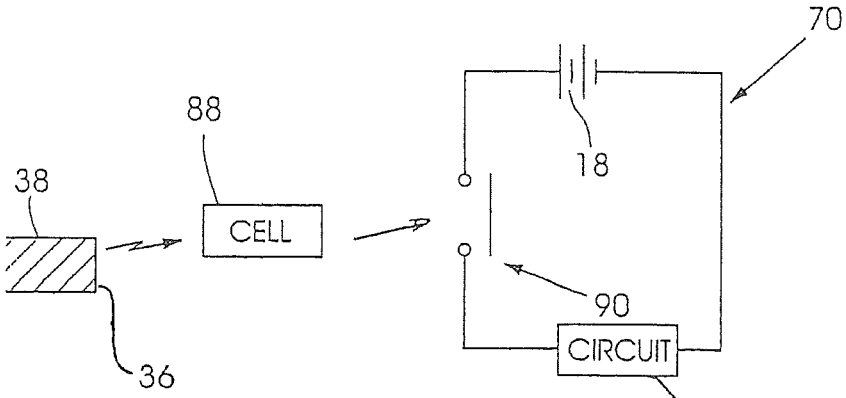

In the arrangement shown in FIG. 6 a switching action is achieved by a light sensitive cell 88 and a switching unit 90. The cell is exposed to light which is emitted from an end 36 of a shock tube 38 when a shock wave reaches the end 36. The cell 88 generates a voltage which is used to close the switching circuit 90 which, in turn, connects the battery 18 to the circuit 10.

Referring again to FIG. 1, each switch 14 and 16 should, preferably, be responsive to a different form of energy which is emitted from an end of a shock tube. Thus, the switch 14 may be responsive to a pressure wave as is the case in the arrangement shown in FIG. 4. The switch 16 may be responsive to light energy as is the case in the FIG. 5 and FIG. 6 arrangements. In addition, the shunt 20 may be open circuited by means of a pressure wave system as is shown in FIG. 3.

Figure 7:
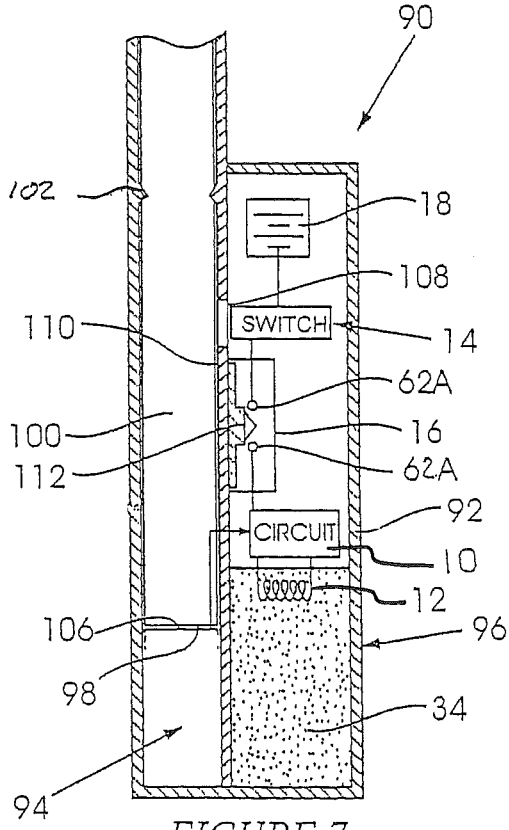
FIG. 7 depicts one type of construction of a detonator according to the invention.

FIG. 7 illustrates one possible construction of a detonator 90 which includes a detonator tube 92 which is divided into compartments 94 and 96, respectively. An end 98 of a shock tube 100 is located in the compartment 94 and is crimped to the compartment at a number of locations 102. The end 98, positioned inside the compartment, opposes a shunt wire 106 generally of the type described in connection with FIG. 1, which electrically bridges a fuse head 12.

A battery 18 is positioned inside the compartment 96 and is connected to a first switch 14 which opposes a window 108 in a wall 110 between the two compartments. The switch 14 is electrically connected in series to a second switch 16 which, in turn, is connected to a circuit 10. The fuse head 12 of the detonator is exposed to primary explosive 34.

The switch 14 may, for example, be of a kind shown in FIG. 5 or in FIG. 6 in that it responds to light emitted by the shock tube 100 when a shock wave reaches the compartment 94. The switch 16 may be of the kind shown in FIG. 4 in that it includes a plunger 112 which is driven, to bridge contacts 62A and 62A, by a pressure wave when the wave reaches the plunger.

With the arrangement shown in FIG. 7, when a shock wave in the shock tube reaches the detonator tube, the light sensitive switch 14 responds by closing a connection between the battery 18 and the switch 16. The latter switch is closed by a pressure wave and the battery is thereby connected to the circuit. Finally, the shunt wire 106 is destroyed or at least open circuited by the shock wave and it is therefore possible for the circuit 10, under the control of its onboard intelligence, to connect the battery 18 to the ignition element 12 which is embedded in the explosive 34 and set off the detonation process.

Figure 8:
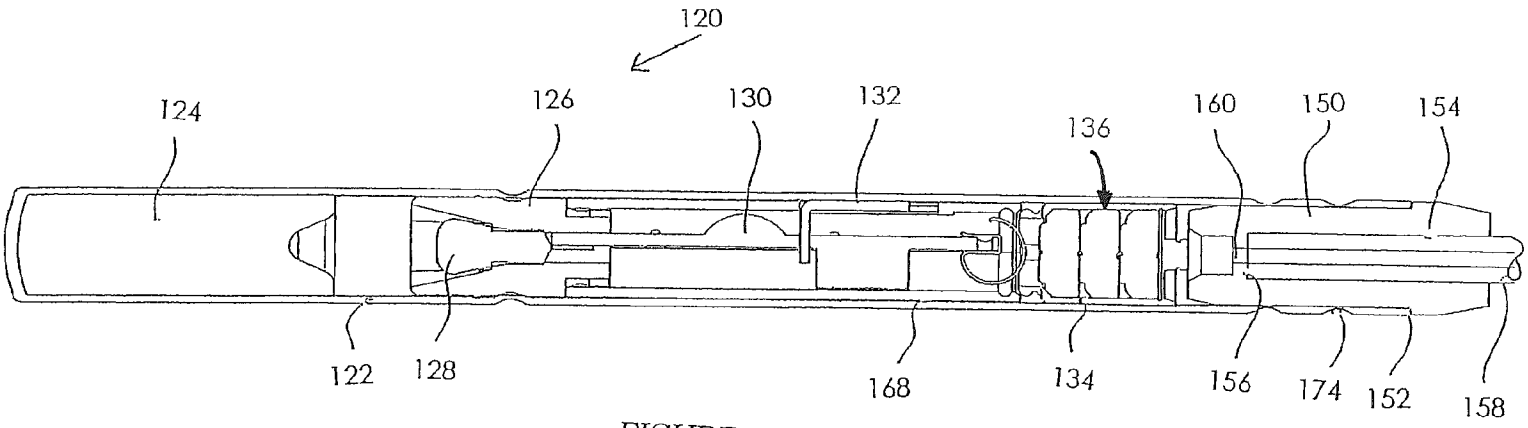
FIGS. 8 and 9 are two views in cross section of another form of the invention.
Figure 9:
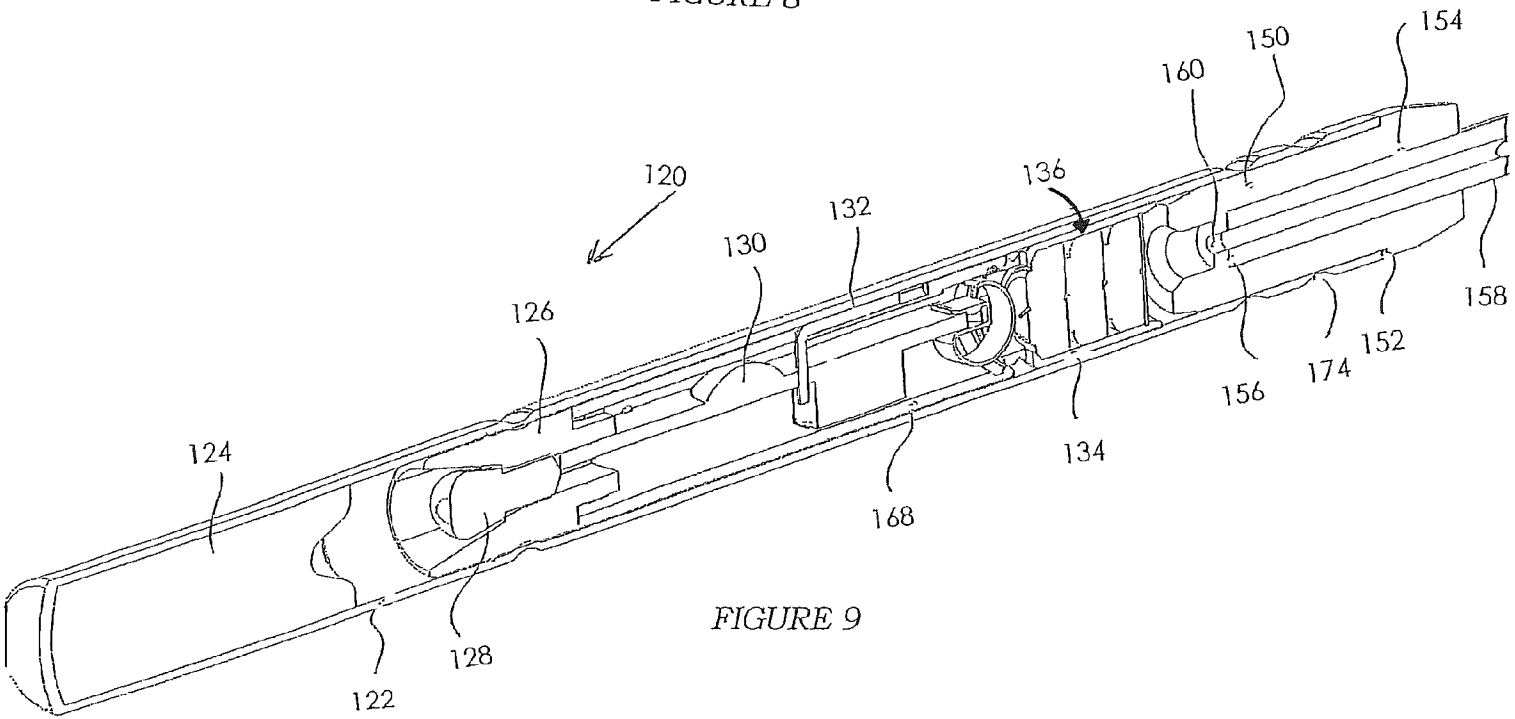

FIGS. 8 and 9 show, on different scales, a detonator 120 in cross-section from one side, and in perspective, respectively. The detonator includes an elongate tubular housing 122 which is made from a conductive material, e.g., an appropriate metal (copper or aluminium), or which contains one or more elongate conductors. Positioned inside the housing is a primary explosive 124 and structure 126 which supports a fuse 128. The fuse is connected to a circuit 130 of any appropriate kind. A positive terminal 132, to the circuit, is electrically connected to the conductive housing 122 or to one of the conductors, as the case may be.

Figure 10:
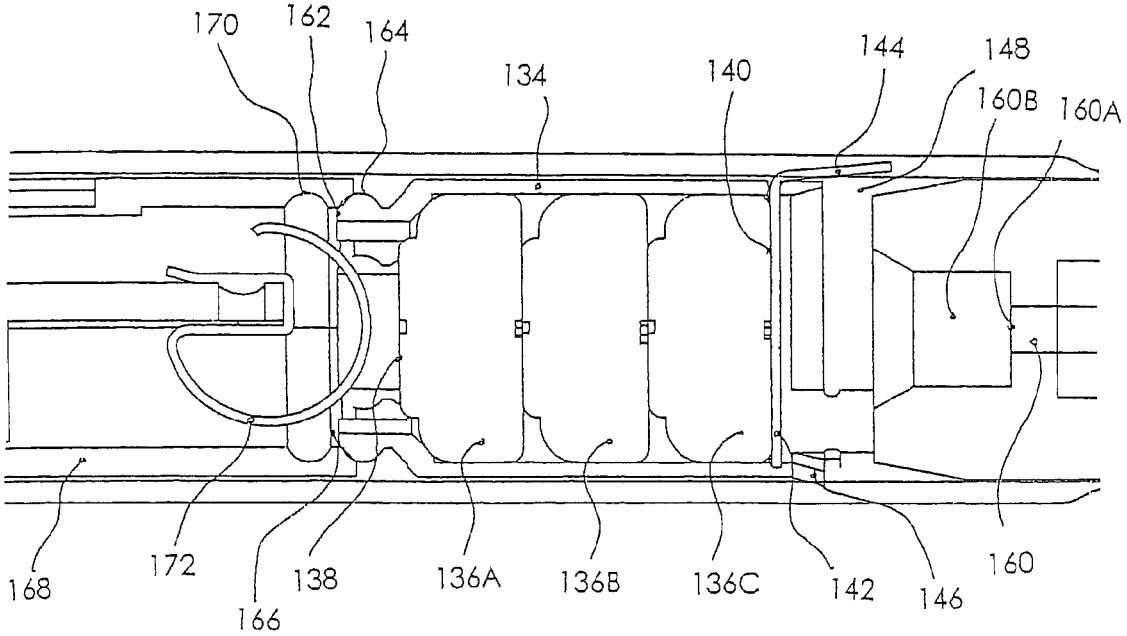
FIG. 10 shows part of the arrangement in FIG. 8, on an enlarged scale.

As best seen in FIG. 10, cartridge 134 made, for example, from a suitable encapsulating and insulating plastics material, carries a number of batteries 136 (FIGS. 8 and 9) which are connected in series. A leading battery 136A has a protruding negative terminal 138 while a trailing battery 136C has a positive terminal 140 which is in electrical contact with a conductive plate 142. One or more tabs 144, projecting from the plate, are in continuous electrical contact with the conductive housing 122 or a conductor inside the housing, as the case may be. The cartridge has a skirt 146 which fits fairly closely against an inner surface 148 of the housing 122.

Referring to FIG. 8, a connector 150 at an end 152 of the housing has a mouth 154 shaped to receive an end 156 of a shock tube 158. Suitable crimping formations 174 retain the shock tube engaged with the housing. A small passage 160 (best seen in FIG. 10) extends through the connector from the shock tube end to a base of the connector 150.

The shape and size of the passage 160 are carefully chosen. If the passage is too large in cross-sectional area the shock tube can exert so much force on the cartridge that the detonator can be mechanically destroyed. If the cross-sectional area is too small, insufficient force is applied to the cartridge to produce effective cartridge movement.

It has been found that the cartridge 134 is propelled in an effective way if the passage 160 has, as best seen in FIG. 10, a small area initial section 160A and a relatively large area outlet section 160B. The small section 160A limits the amount of energetic material from the shock tube which is passed through the passage. This material is, however, at a high pressure. The large section 160B distributes the energetic material over a relatively large area and thus reduces the pressure of the energetic material. This results in a fairly evenly distributed, relatively low pressure, shock wave of energetic material being applied to the plate 142.

The cartridge 134, at a leading end 162, has a retention formation 164 which is slightly larger in diameter than the diameter of a mouth 166 in a holder 168, which has a retention formation 170 near the mouth. A spring terminal 172, electrically connected to the circuit 130, opposes the terminal 138 at the leading end of the batteries.

Referring to FIG. 8, when the shock tube is ignited, a pressure wave advances along the shock tube 158 and ultimately reaches the end 156 which is inside the connector 150. A high-energy jet of combustion products is emitted through the passage 160, in the manner described, and (FIG. 10) strikes the outer face of the plate 142. The cartridge is thereby propelled towards the holder 168. This movement is, however, only possible if the force applied to the cartridge 134 is sufficiently high to overcome the retention force of the formation 164. When this happens, the formation 164 is deformed resiliently inwardly and the cartridge can then move to the left relative to the holder 168. The formation 164 enters the retention formation 170 in the holder and the cartridge is thereby physically locked to the holder. At the same time, the terminal 138 strikes the spring contact 172, which is connected to the circuit, and the negative terminal of the battery assembly is thereby electrically connected to the circuit. The switching action is provided by movement of the cartridge and the batteries towards the circuit 130. Further steps in the detonation process can then take place in a substantially conventional manner because the circuit has a source of electrical power.

Figure 11:
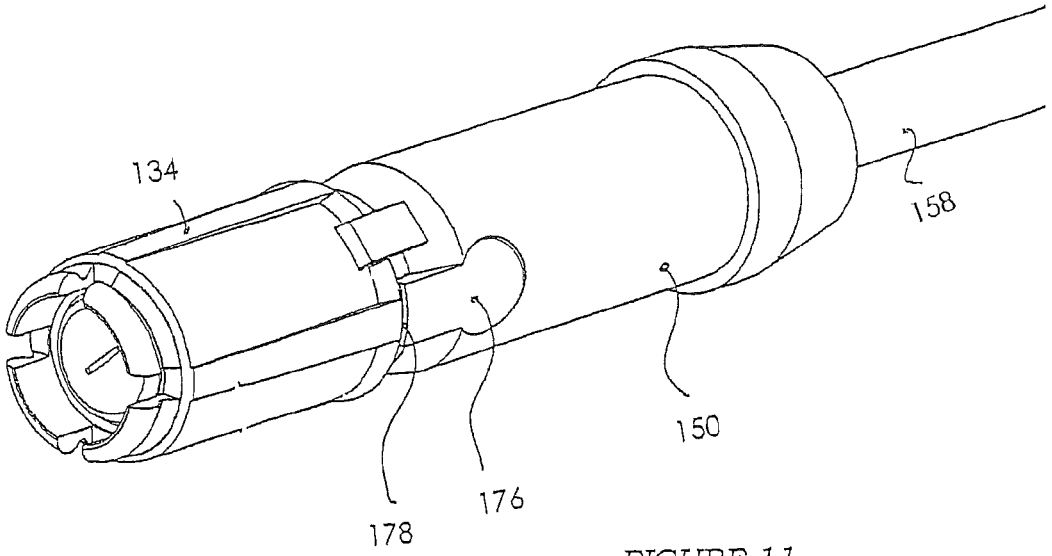
FIG. 11 is a perspective view of a connector.

As shown in FIG. 11, to retain the cartridge 134 in position before the energy of the shock tube 158 reaches the detonator, two retaining tabs 176 (of keyhole shape) on the cartridge 134 locate into two opposing pockets (not shown) in the connector 150.

Each retaining tab 176 has a respective region 178 of reduced thickness which is sheared by the force exerted by the energy from the shock tube, thus allowing the cartridge 134 to move towards the holder 168.

In a variation of the arrangement, the circuit, and not the battery, is moved relative to the detonator housing.

The arrangement shown in FIGS. 8 and 9 should, preferably, be used in conjunction with one of the techniques previously described herein in that, ideally, at least two events must take place, substantially simultaneously, for an acceptable electrical connection to be established between the battery and the circuit.

An advantage of the approach embodied in the present invention is that the shock tube is used to place the electronic detonator in a condition in which it can be fired but, once this condition is established, the firing takes place in an electronic manner. The requirement for electrical conductors to interconnect electronic detonators in a blasting system is thus substantially reduced, if not eliminated.

The invention claimed is:

1. A detonator which includes a circuit comprising an ignition element, an electrical energy source, at least a first switch which is operable in response to energy emitted by a shock tube to connect the electrical energy source to the circuit so that the circuit is then capable of generating a firing signal to ignite the ignition element, and a shunt positioned in the circuit to conduct the firing signal primarily around the ignition element, which shunt is open-circuited by energy emitted from the shock tube, and wherein the firing signal can ignite the ignition element only if the shunt has been open-circuited.

2. A detonator according to claim 1 which includes at least a second switch which is operable in response to energy emitted by the shock tube, and wherein the switches are connected so that the electrical energy source is connected to the circuit only if both switches are operated in response to energy emitted by the shock tube.

3. The detonator of claim 2 wherein the energy emitted from the shock tube is comprised of light energy and a pressure wave, the first and second switches are respectively responsive to a different form of the energy emitted from the shock tube, the first switch being responsive to the light energy emitted from the shock tube and the second switch being responsive to the pressure wave emitted from the shock tube.

4. The detonator of claim 2 wherein the circuit comprises a further switching mechanism, and the shunt is open-circuited by energy from the shock tube actuating the further switching mechanism.

5. A detonator according to claim 2 which includes a discharge device and wherein, if the circuit does not generate a firing signal within a predetermined time period after at least the first switch is operated, the discharge device is operable to discharge the electrical energy source so that it is incapable of operating the circuit.

6. A detonator according to claim 1 which includes a discharge device and wherein, if the circuit does not generate a firing signal within a predetermined time period after at least the first switch is operated, the discharge device is operable to discharge the electrical energy source so that it is incapable of operating the circuit.

7. The detonator of claim 1 wherein the circuit comprises a further switching mechanism, and the shunt is open-circuited by energy from the shock tube actuating the further switching mechanism.

8. The detonator of claim 1 wherein the energy emitted from the shock tube is comprised of light energy and a pressure wave, the circuit comprises two switches which are respectively responsive to a different form of the energy emitted from the shock tube, one switch being responsive to the light energy emitted from the shock tube and the other switch being responsive to the pressure wave emitted from the shock tube.

* * * * *

UNITED STATES PATENT AND TRADEMARK OFFICE

CERTIFICATE OF CORRECTION

PATENT NO. : 8,695,505 B2
APPLICATION NO. : 13/145592
DATED : April 15, 2014
INVENTOR(S) : Andre Louis Koekemoer et al.

It is certified that error appears in the above-identified patent and that said Letters Patent is hereby corrected as shown below:

On the Title Page, Item "(22) PCT Filed:", replace "Jan. 10, 2010" with -- Oct. 1, 2010 --.

In the Specification

In column 1, line 8, replace "Jan. 10, 2010" with -- Oct. 1, 2010 --.

Signed and Sealed this
Sixteenth Day of September, 2014

Michelle K. Lee

Michelle K. Lee
*Deputy Director of the United States Patent and Trademark Office*